US005230435A

United States Patent [19]

Mo

[11] Patent Number: 5,230,435

[45] Date of Patent: Jul. 27, 1993

[54] BENDABLE LOAD CARRIER

[76] Inventor: Yhu-Kee Mo, Flat 02 10th Floor Block A, Lotto Villa, 18 Broadwood Rd., Happy Valley, Hong Kong

[21] Appl. No.: 977,954

[22] Filed: Nov. 18, 1992

[51] Int. Cl.[5] ..... B65D 6/18

[52] U.S. Cl. ..... 220/7; 217/15

[58] Field of Search ..... 220/7, 6; 217/15, 47

[56] References Cited

U.S. PATENT DOCUMENTS 4,057,165 11/1977 Kardell ..... 220/7
4,630,747 12/1986 Chang et al. ..... 220/7
4,688,979 9/1987 Kupersmit ..... 220/7
4,820,383 4/1989 Shchamorov et al. ..... 220/7
4,826,040 5/1989 Jahr et al. ..... 220/7

*Primary Examiner*—Joseph Man-Fu Moy
*Attorney, Agent, or Firm*—Panitch Schwarze Jacobs & Nadel

[57] ABSTRACT

A load carrier (20) has a bottom member (21) and a surrounding wall (22) disposed on the bottom member (21). A connector (213) connects detachably the bottom member (21) and the surrounding wall (22) so as to form the load carrier (20). The surrounding wall (22) is made of a tough and bendable material and is foldable after it has been detached from the bottom member (21).

2 Claims, 5 Drawing Sheets

BENDABLE LOAD CARRIER

BACKGROUND OF INVENTION

1. Field of Invention

This invention relates to a load carrier, more particularly to a load carrier which includes a bottom member and a surrounding wall that is connected detachably to the periphery of the bottom member. 2.Description of the Related Art A conventional load carrier includes a bottom member and a surrounding wall connected to the periphery of the bottom member so as to confine a load receiving space therein. The load carrier is generally made from metal, rattan stem, bamboo strap or bendable plastic material. In the conventional load carrier, the surrounding wall is integrally formed with the bottom member. Therefore, the load carrier has a predetermined shape and height. Thus, a large vehicle is needed to ship the conventional load carriers to a desired destination. Hiring a large vehicle results in higher transport costs.

SUMMARY OF THE INVENTION

A main object of the present invention is to provide a load carrier that includes a base member and a surrounding wall which is detachable therefrom and bendable so as to reduce the space occupied thereby when load carrier is shipped, thus resulting in lower transport cost.

A load carrier of the present invention includes a bottom member and a surrounding wall provided on the periphery of the bottom member. The bottom member includes a hard plate, a tough and bendable layer that is configured to and that is superimposed on a lower surface of the hard plate, and a connector provided between the hard plate and the tough and bendable layer. The connector has a curved hook extending outwardly from peripheries of the hard plate and the tough and bendable layer. The connector has barbed hooks extending into the interior of the hard plate and the tough and bendable layer. The surrounding wall is made from a tough and bendable material and has a connecting rod provided adjacent to the lower portion of the same. The curved hook of the connector engages detachably the connecting rod of the surrounding wall. The surrounding wall can be detached from the bottom member and can be folded so that the load carrier occupies less space when compared to the prior art.

BRIEF DESCRIPTION OF THE DRAWINGS

Other features and advantages of the present invention will become more clearly in the following detailed description, including drawings, all of which show a non-limiting form of the present invention, and in which.

DETAILED DESCRIPTION OF THE PREFERRED EMBODIMENT

Figure 1:
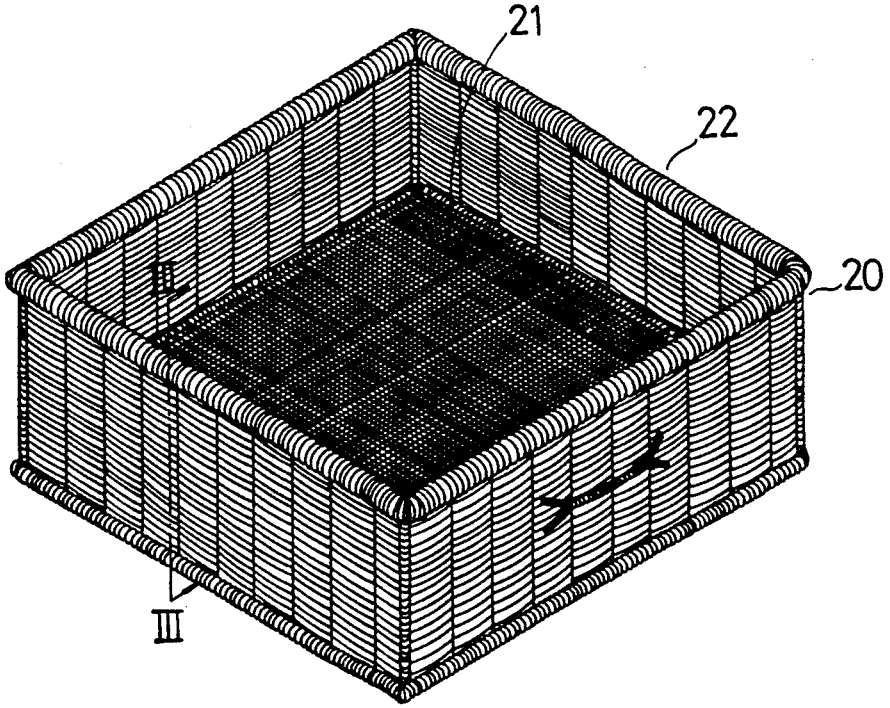
FIG. 1 is a perspective, schematic view of a preferred embodiment of a load carrier of the present invention.
Figure 2:
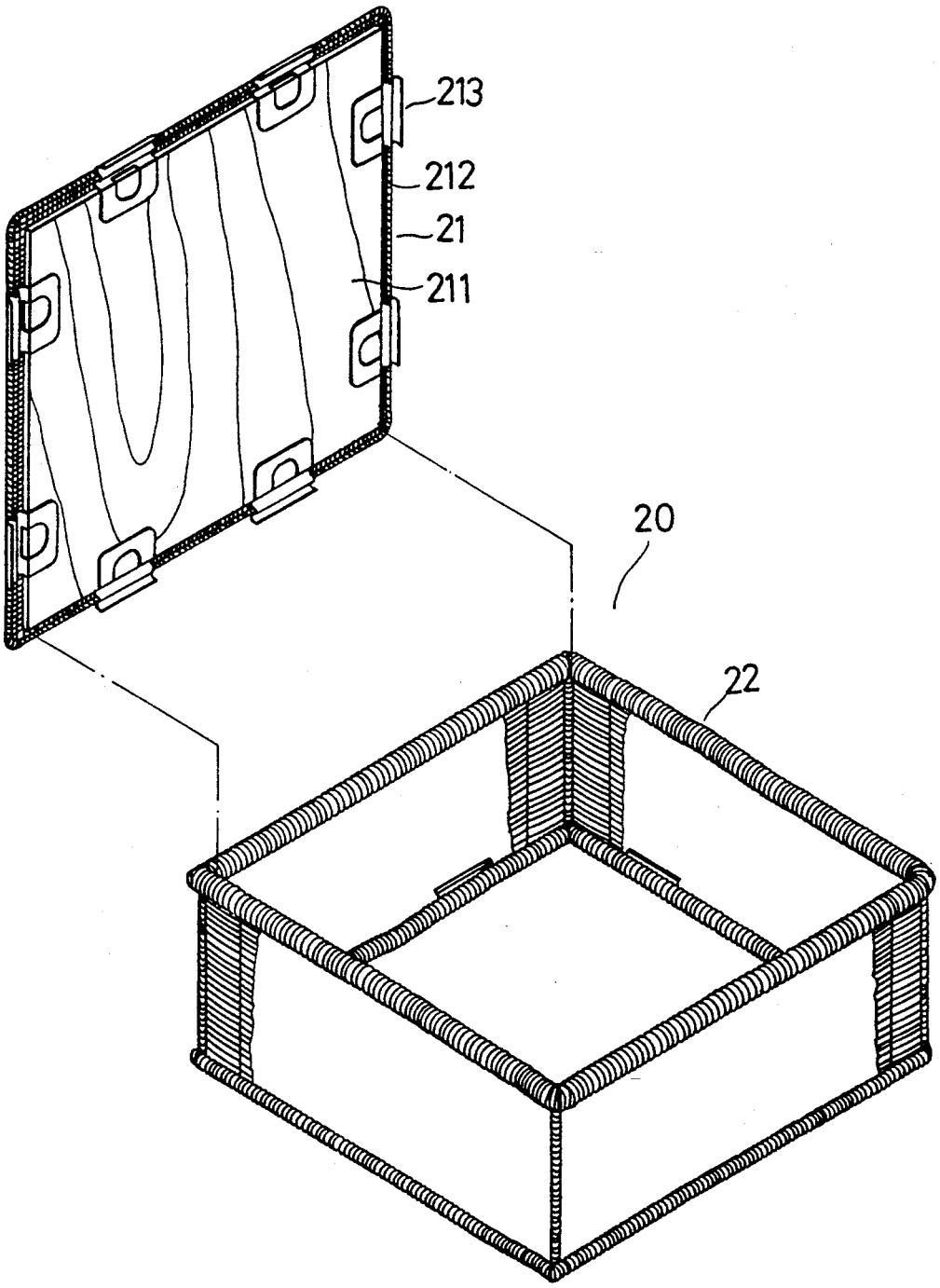
FIG. 2 is an exploded view of the preferred embodiment.

Referring to FIGS. 1 and 2, a load carrier (20) of the present invention is shown to comprise a bottom member (21) and a surrounding wall (22).

The feature of the present invention resides in the structural connection between the bottom member (21) and the surrounding wall (22), and the foldable characteristics of the surrounding wall (22) when the surrounding wall (22) is detached from the bottom member (21). In this embodiment, the surrounding wall (22) is rectangular in shape and has four side walls. The four side walls are made from a tough and bendable material (30), such as rattan stem, bamboo stick or flexible plastic. The four side walls are hinged together so as to form the surrounding wall (22). Each of the four side walls has a connecting rod (222), generally made of metal, connected thereto adjacent to the lower portion of the same.

Figure 3:
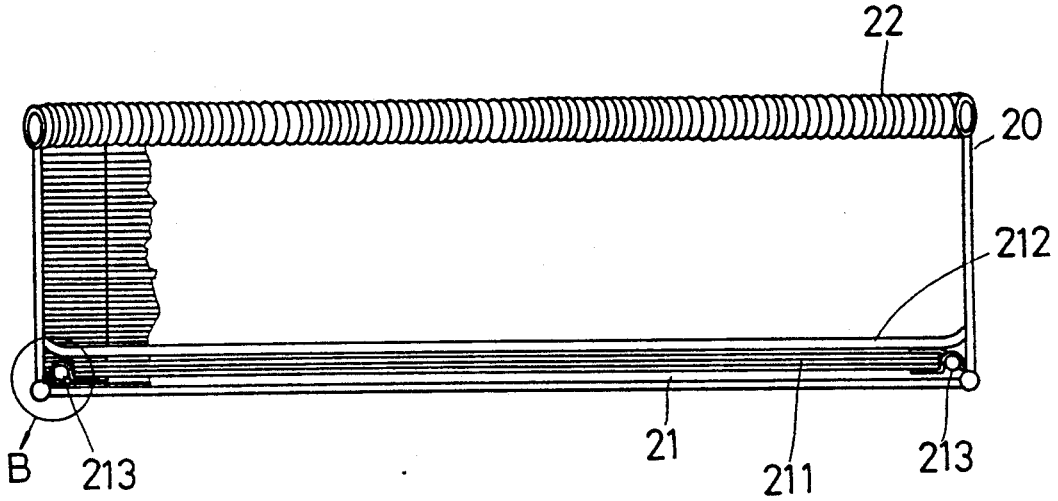
FIG. 3 shows a cross sectional view of FIG. 1 taken along the line III—III.
Figure 4:
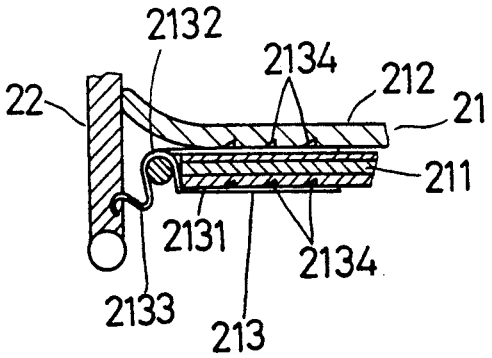
FIG. 4 shows an enlarged view of an encircled portion (B) in FIG. 3.

The bottom member (21) of the preferred embodiment is similarly rectangular in shape and includes a hard plate (212), such as a three-plied wood, and a tough and bendable layer (211) which is made from rattan stem, bamboo material or flexible plastic, and which is superimposed to a lower surface of the hard plate (212). A connector (213) includes a first metal plate and a second metal plate which cooperatively define a receiving space to receive the tough and bendable layer (211) therebetween. The connector (213) is provided between the hard plate (212) and the tough and bendable layer (211). The first and second metal plates of the connector (213) have a plurality of barbed hooks (2134) that extend into the interior of the hard plate (212) the tough and bendable layer (211), thereby holding together the hard plate (212) and the tough and flexible layer (211) as one unit. A curved hook (2132) and an engaging peg (2133) are formed at one end of the connector (213). When it is desired to use the load carrier (20) of the present invention, the curved hook (2132) is hooked onto the connecting rod (222) of the surrounding wall (22), while the engaging peg (2133) is inserted into the woven surrounding wall (22) below the connecting rod (222). When the load is received in the receiving space confined by the surrounding wall (22), the weight of the load will provide a force on bottom member (21), which force will cause the engaging peg (2133) of the connector (213) to engage more firmly in the woven surrounding wall (22). Thus the connector (213) provides firm engagement between the surrounding wall (22) and the bottom member (21), as shown in FIGS. 3 and 4.

Figure 5:
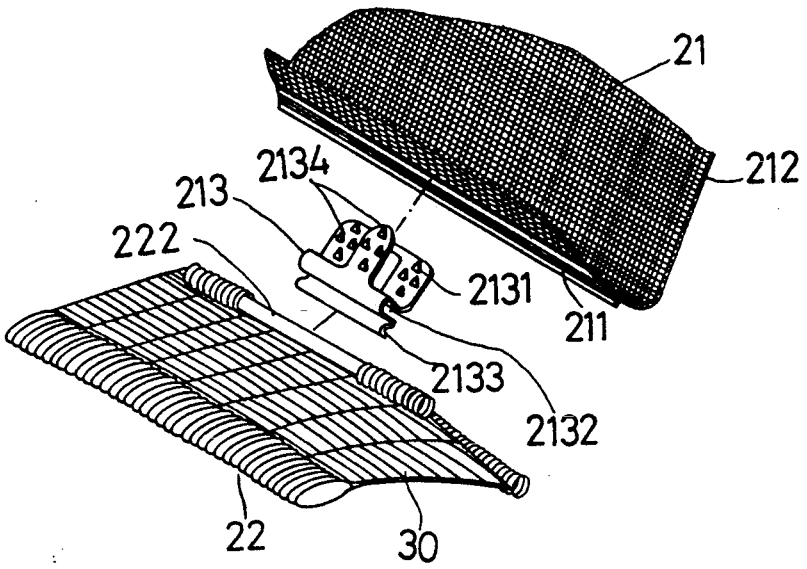
FIG. 5 is an exploded view of the portion shown in FIG. 4.
Figure 6:
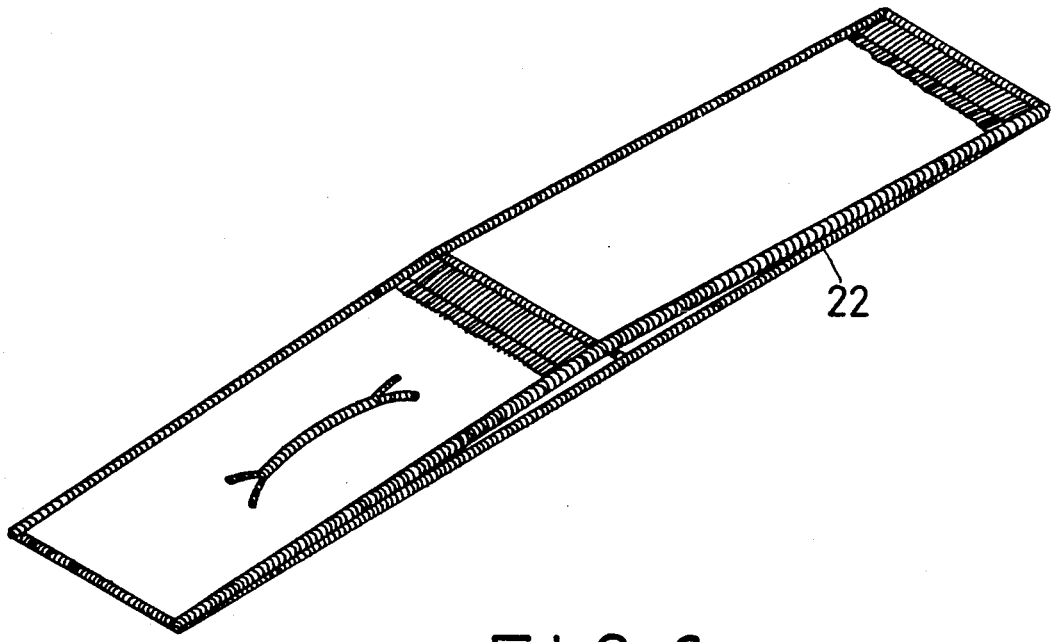
FIG. 6 shows a surrounding wall of the preferred embodiment when bent to facilitate transport of the latter.

In the event that a plurality of load carriers (20) of the present invention are to be transported to a desired destination, the bottom member (21) can be detached from the surrounding wall (22) by reversing the fixing procedure, as illustrated in FIG. 5. Since the four side walls which cooperatively form the surrounding wall (22) are hinged together, they can be folded as shown in FIG. 6, after the bottom member (21) has been detached therefrom. Thus, all of the bottom member (21) can be stocked on one pile. The surrounding walls (22) are also arranged in a similar manner. A large room is not required when storing a plurality of load carriers. Furthermore, a large vehicle is not required when transporting a plurality of load carriers (20) of the present invention. The features and objects of the present invention are thus achieved.

Figure 7:
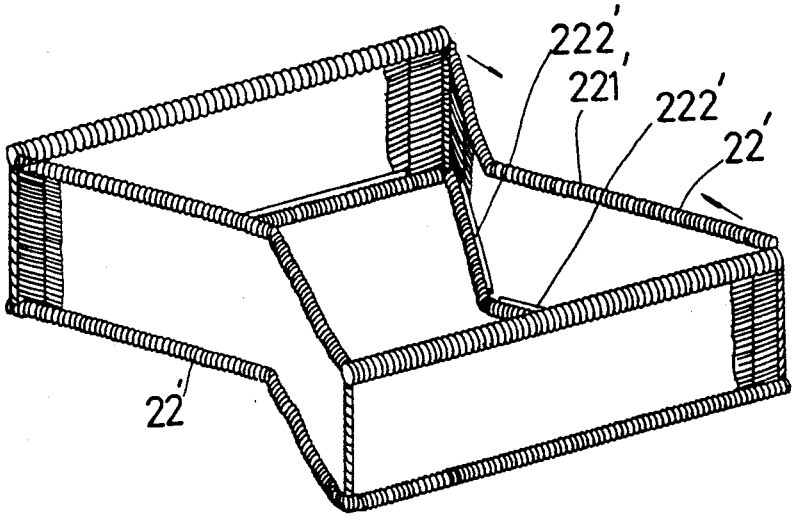
FIG. 7 shows a second preferred embodiment of the load carrier of the present invention.

Referring to FIG. 7, a second preferred embodiment of a load carrier of the present invention includes a surrounding wall (22') that has two opposite side walls (221'). Each of the side walls (221') has two foldable sections. Two connecting rods (222') are provided adjacent to the its lower portion of the side walls (221'). The connector (213) connects the side wall (221') to the bottom member (21) in a manner similar to that described in the first preferred embodiment. After the surrounding wall (22') has been detached from the bottom member (21), the surrounding wall (22') can be folded by pushing the side walls (221') interiorly of the same.

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A bendable load carrier (20) including a bottom member (21) made from a tough and bendable material and a surrounding wall (22) also made from a tough and bendable material and having a lower portion connected to the periphery of said bottom member (21); characterized in that said bottom member (21) includes a hard plate (212), a tough and bendable layer (211) configuring to and being superimposed on a lower surface of said hard plate (212) and a connector (213) provided between said hard plate (212) and said tough and bendable layer (211), said connector having a curved hook (2132) extending outwardly from peripheries of said hard plate (212) and said tough and bendable layer (211), said connector (213) further having a plurality of barbed hooks (2134) extending into interior portions of said hard plate (212) and said tough and bendable layer (211);

said lower portion of said surrounding wall (22) having a connecting rod (222) connected thereto, said curved hook (2132) of said connector (213) engaging detachably said connecting rod (222) of said surrounding wall (22).

2. A bendable load carrier as defined in claim 1, characterized in that said connector (213) is one-piece metal clamp that includes first and second metal plates said first and second metal plates having integrally formed first ends and second ends opposite to said first ends and spaced from one another so as to confine a receiving space, said receiving space accommodating said tough and bendable layer (211) therein, said curved hook (2132) being integrally formed with said first ends of said first and second metal plates, said barbed hooks (2134) being formed on upper surfaces of said first and second metal plates, said connector (213) further having an engaging peg (2133) extending from said curved hook (2132) and engaging detachably said lower portion of said surrounding wall (22).

* * * * *

UNITED STATES PATENT AND TRADEMARK OFFICE

CERTIFICATE OF CORRECTION

PATENT NO. : 5,230,435

DATED : July 27, 1993

INVENTOR(S) : YAU-KEE MO

It is certified that error appears in the above-identified patent and that said Letters Patent is hereby corrected as shown below:

At item [76] of the cover sheet "Yhu-Kee Mo" should read --Yau-Kee Mo--.

Signed and Sealed this

First Day of March, 1994

*Attest:*

*Attesting Officer*

BRUCE LEHMAN

*Commissioner of Patents and Trademarks*